United States Patent [19]

Itoi

[11] Patent Number: 4,502,154

[45] Date of Patent: Mar. 5, 1985

[54] OUTERWEAR AND BAG IN ONE

[76] Inventor: Toru Itoi, 861-11, Komatsuri-Cho, Kishiwada-Shi, Osaka, Japan

[21] Appl. No.: 488,069

[22] Filed: Apr. 25, 1983

[51] Int. Cl.[3] ..... A41B 9/00

[52] U.S. Cl. ..... 2/108

[58] Field of Search ..... 2/108, 88, 94, 85

[56] References Cited

U.S. PATENT DOCUMENTS

| | | | |
|---|---|---|---|
| 2,919,443 | 1/1960 | Kashigama | 2/108 |
| 2,959,789 | 11/1960 | Mills et al. | 2/108 |
| 4,307,470 | 12/1981 | Ezell | 2/108 |

*Primary Examiner*—Doris L. Troutman

*Attorney, Agent, or Firm*—McAulay, Fields, Fisher, Goldstein & Nissen

[57] ABSTRACT

An outerwear and bag in one for wearing when going out for sports and hiking, is disclosed, which has a pocket section tied to the inner side of the back of the outerwear. When the outerwear and bag in one is taken off, the outerwear can be accommodated in the pocket section into the form of a knapsack which can be carried on the back or shouldered.

The pocket section is tied to the inner side of the back of the outerwear. It can be taken with its inner side out to the outside through an opening provided in the back of the outerwear. In this state, the whole outerwear can be inserted into the pocket section, and the pocket section then can be closed by pulling strings provided around the opening. In this state, the outerwear and bag in one can be carried on the back or shouldered.

9 Claims, 6 Drawing Figures

OUTERWEAR AND BAG IN ONE

BACKGROUND OF THE INVENTION

During an outing, one sometimes encounters a temperature rise halfway. When because of this one removes an article of clothing, this article must be carried by hand, which is cumbersome.

SUMMARY OF THE INVENTION

The primary object of the invention is to provide an outerwear and bag in one, which has a pocket section provided on its back and capable of accommodating the rest of it just like a bag or knapsack when it is taken off so that it can be carried on one's back or shouldered in the form of the bag.

A second object of the invention is to provide an outerwear and bag in one, which has hanger bands provided around the opening of the pocket section to be used when carrying it on one's back or shouldering it in the form of the bag and also used as waist bands.

BRIEF DESCRIPTION OF THE DRAWINGS

The above and further objects, features and advantages of the invention will become more apparent from the following description when the same is read with reference to the accompanying drawings, in which.

DETAILED DESCRIPTION OF THE PREFERRED EMBODIMENTS

Figure 1:
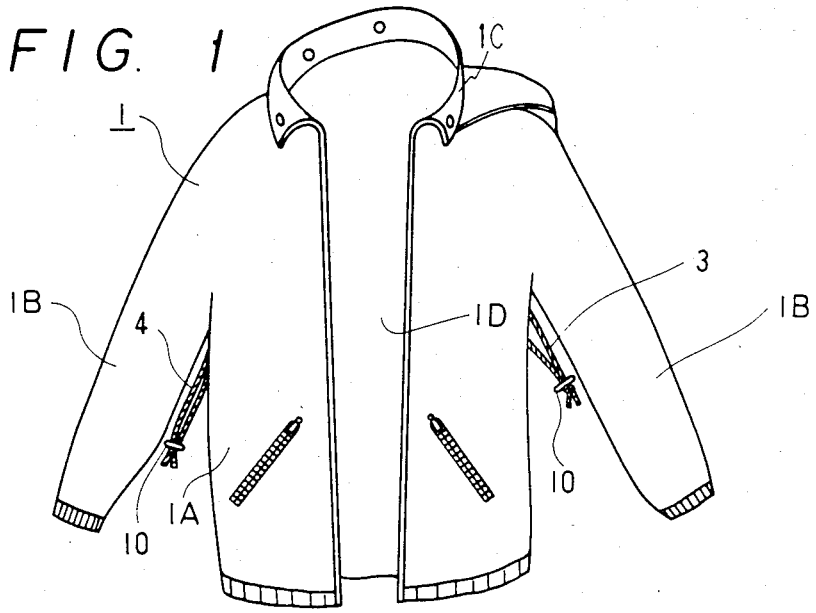
FIG. 1 is a front view showing an outerwear and bag in one according to the invention.
Figure 2:
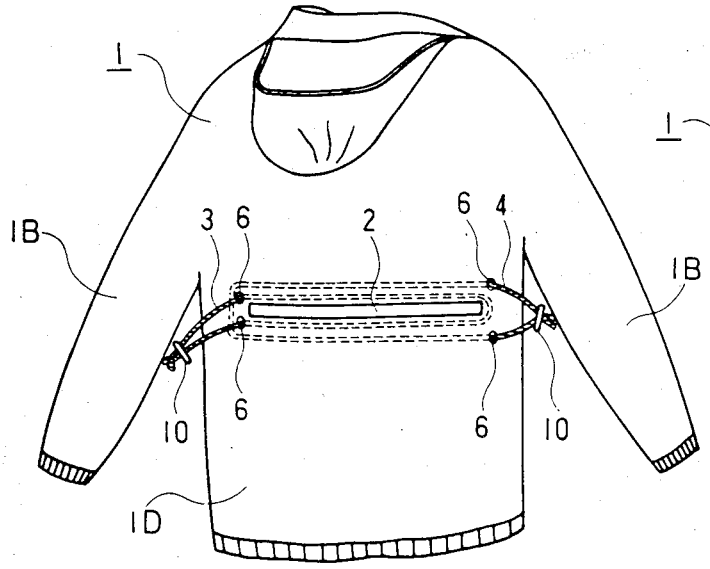
FIG. 2 is a back view showing the same outerwear and bag in one.
Figure 3:
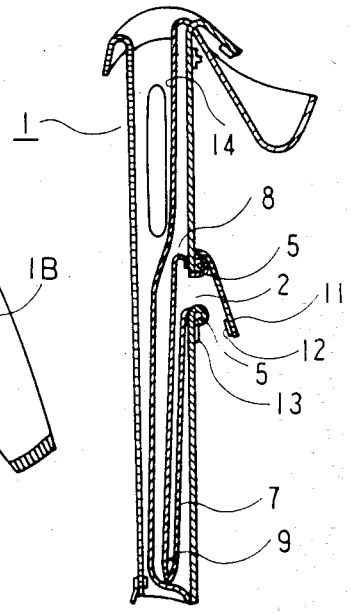
FIG. 3 is a sectional view of the same outerwear and bag in one.

The outerwear and bag in one comprises an outerwear, which includes an outerwear body 1A, sleeves 1B and a collar 1C. The back 1D of the outerwear 1 is provided in a portion slightly below the stems of the sleeves 1B with a horizontal opening or slit 2. Two loop strings 3 and 4 are provided around the opening 2. The loop strings 3 and 4 are accommodated in elongate receiving portions 5 provided on the back 1D. They project outwards from openings 6 provided at the opposite ends of the receiving portions 5 near the stems of the sleeves 1B. The opening 2 can be squeezedly closed by outwardly pulling the loop strings.

A pocket section 7 is provided on the inner side of the back 1D. It is of a size large enough to accommodate the whole outerwear. The opening 8 of the pocket section 7 is sewn to the edge of the opening a, and the pocket can be taken with its inside out to the outside through the opening 2. Pocket 7 has loop-like hooks 9 provided on the opposite ends of its inside bottom. The loop strings 3 and 4 are provided at their opposite ends with short bars 10, which can be hooked on the hooks 9.

The back 1D is provided with a flap 11 which covers the opening 2. The flap 11 can be fastened by adhesive bands Velcro 12 and 13. The inside of the back 1D is provided with an inner liner 14 which covers the pocket section 7.

Figure 4:
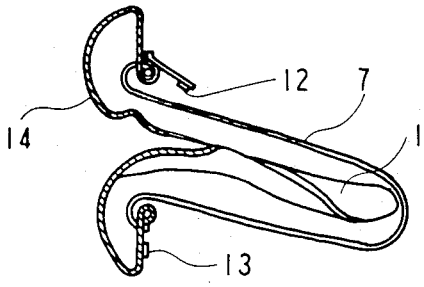
FIGS. 4 and 5 are views illustrating the way in which the outerwear and bag in one is converted from the normal state into a state in which it is accommodated in its pocket section.
Figure 5:
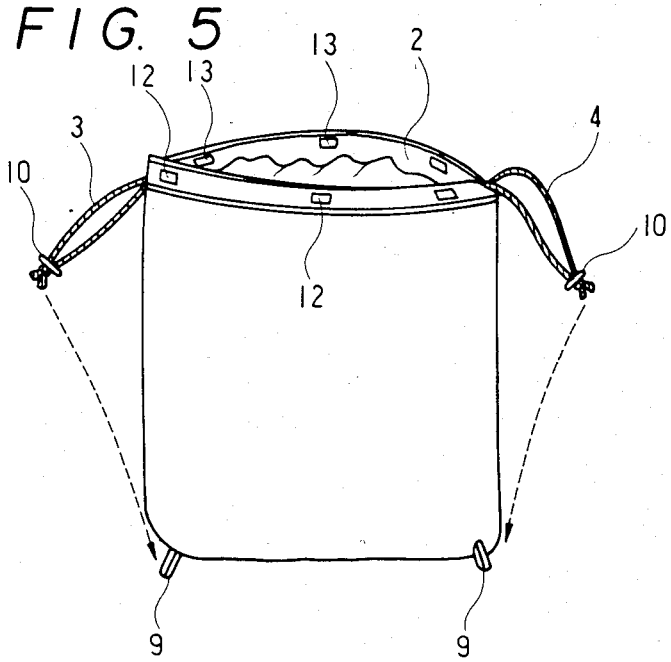
Figure 6:
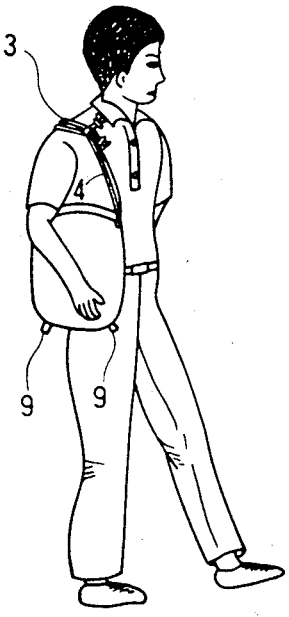
FIG. 6 is a view showing the outerwear and bag in one according to the invention shouldered in the form of a bag.

The outerwear and bag in one can be worn in its normal state. When it is not worn, the whole outerwear can be accommodated in the pocket section 7 after taking out the pocket section 7 from the inside thereof as shown in FIG. 4. By so doing, the pocket section 7 can be converted into a knapsack as shown in FIG. 5. Articles may also be accommodated together with the outerwear. Afterwards, the opening 2 of the pocket section 7 may be closed by pulling the loop strings 3 and 4. The knapsack thus formed may be carried on the back by hooking the bars 10 at the ends of the loop strings 3 and 4 on the hooks 9. Also it may be shouldered by tying the strings together.

The strings 3 and 4 may be made sufficiently long so that they may be tied together as a waist band when the outerwear and bag in one is worn.

As has been described in the foregoing, the outerwear and bag in one comprises the outerwear having on the back thereof lateral opening, and a pocket section having the open edge 8 tied to the edge of the lateral opening 2 and capable of accommodating the whole outerwear, strings being provided around the lateral opening, whereby the pocket section can be used as a knapsack to carry along with the outerwear and belongings, if any, therein. The outerwear and bag in one thus can be carried on the back or shoulders to free the hands and avoid losing the outerwear.

What is claimed is:

1. A combined garment and bag, comprising:

a garment having a back portion;

a pocket having an open upper end secured to the inner side of said back portion;

a horizontal slit on said back portion communicating with said upper end of said pocket;

loops surrounding said slit;

strings in said loops for closing said slit;

spaced fastening means at the lower end of said pocket; and complementary fastening means at the ends of said strings for carrying said combined garment and bag as a knapsack or shouldering the same by tying the ends of said strings together.

2. The article as defined in claim 1, wherein said strings are long enough to be tied together as a waist band.

3. The article as defined in claim 1, wherein said slit is dimensioned so as to allow said pocket to pass through inside out to insert all of said garment in said pocket.

4. The article of claim 1, further including a flap covering said slit, and means for releasably securing said flap to the outside of said back portion.

5. The article of claim 1, further including a liner on the inside of said back portion and covering said pocket.

6. The article of claim 1, including a pair of spaced elongate receiving portions provided on said back portion on opposite sides of said slit, said strings being received in said elongate receiving portions.

7. The article of claim 1, wherein said spaced fastening means is a loop-like hook.

8. The article of claim 1, wherein said complementary fastening means includes short bars which can be hooked onto said spaced fastening means.

9. The article of claim 1, wherein said strings are long enough to be tied together to carry the bag as a shoulder bag.

* * * * *